United States Patent [19]

Jones, Jr.

[11] 4,059,202

[45] Nov. 22, 1977

[54] COVER PLATE HAVING ADJUSTABLE LATCH MEANS

[75] Inventor: John P. Jones, Jr., Greenwich, Conn.

[73] Assignee: Mobil Oil Corporation, New York, N.Y.

[21] Appl. No.: 776,086

[22] Filed: Mar. 9, 1977

[51] Int. Cl.[2] ..... B65D 45/16

[52] U.S. Cl. ..... 220/325; 220/3.7; 292/241

[58] Field of Search ..... 220/323–325, 220/327, 328, 3.7, 3.8; 292/241

[56] References Cited

U.S. PATENT DOCUMENTS

| | | | |
|---|---|---|---|
| 372,680 | 11/1887 | Ketcham | 220/325 X |
| 1,511,610 | 10/1924 | Holmes | 220/325 X |
| 3,184,099 | 5/1965 | Gravert | 220/324 |
| 3,199,713 | 8/1965 | Flachbarth | 220/3.7 |

*Primary Examiner*—George T. Hall
*Attorney, Agent, or Firm*—C. A. Huggett; Drude Faulconer

[57] ABSTRACT

An easily removable cover plate for sealingly closing a service opening or the like through a deck of a vessel into a cargo tank. The cover plate has a plurality of latch means spaced about its periphery which are adjustable without disassembly to compensate for different deck thicknesses with which the cover plate may be used.

10 Claims, 4 Drawing Figures

COVER PLATE HAVING ADJUSTABLE LATCH MEANS

BACKGROUND OF THE INVENTION

This invention relates to a closure or cover plate for an opening and more particularly relates to a cover plate such as a "Butterworth cover" for sealing an opening through the deck of a cargo vessel.

In a typical marine vessel (e.g., an oil tanker) used for transporting fluid products, a plurality of large cargo tanks are positioned in the hull immediately below the deck. At least one relatively large opening if formed through the deck into each tank to provide a main entry into that tank. As is understood in the art, normally several additional, smaller openings are provided through the deck into each tank through which various service operations on the tanks and/or cargo can be carried out. When the service openings are not in use, they are normally sealed by removable cover plates, commonly referred to as "Butterworth covers".

Originally, a Butterworth cover was secured over a service opening by forming holes in the cover which fit over studs fixed to the deck around the service opening and then threading nuts onto the studs. Besides requiring a substantial amount of time and effort to remove and replace a cover plate, the studs had a tendency to corrode and often required replacement. To alleviate such problems, quick-release cover plates were developed.

One such cover plate is disclosed in U.S. Pat. No. 3,184,099, issued May 18, 1965. This cover plate incorporates a cammed latching means which secures or releases the cover plate to or from a deck opening with a simple turn of the latch. However, as recognized in U.S. Pat. No. 3,184,099, the thickness of the deck to which the cover plate is to be secured may vary from cargo vessel to cargo vessel. In order for a cover plate to find widespread utility, it must include some adjustable means to compensate for the various deck thicknesses. The cover plate of U.S. Pat. No. 3,184,099 uses different sizes of shim washers on the shaft of the latch means for this purpose but the latch means has to be disassembled to rearrange the washers to adapt the cover plate for use with a particular deck thickness.

SUMMARY OF THE INVENTION

The present invention provides an easily removable cover plate for sealing an opening, e.g., the service opening through a deck of a vessel into a cargo tank. The cover plate has latch means which can be adjusted without disassembly to compensate for a wide range of different deck thicknesses, thereby making a single cover plate applicable for use on a variety of different cargo vessels.

Specifically, the cover plate of the present invention is comprised of a plate element which is slightly larger than the opening to be sealed. The plate element has a circumferential groove on its underside which carries a seal means which cooperates with the deck around the opening when the cover plate is in position to prevent leakage through the opening. A plurality of adjustable latch means are spaced about and near the outer periphery of the plate element to secure the cover plate to the deck.

Each latch means is comprised of a shaft which extends through and below the plate element and is journaled for rotation in the plate element. A sealing means is carried by the shaft and cooperates with the plate element to prevent leakage around the shaft. The portion of the shaft below the plate element is threaded to receive a threaded lock member. The lower end of the shaft is journaled in a support which is secured between two stop elements which in turn extend from the underside of the plate element on opposite sides of the shaft.

The lock member is substantially circular in configuration throughout part of its periphery and has a flattened side forming the remainder of the periphery. A lug is provided on the lock member which contacts one of the stop elements to hold the lock member in an open position and to move the lock member downward on the shaft when the shaft is rotated in a first direction. All of the lock members of the latch means are moved downward on their respective shafts to a distance slightly greater than the deck thickness to which the cover plate is to be secured.

The cover plate is then positioned over the opening in the deck and the shafts of the latch means are rotated in the opposite direction. The lug on the lock member now contacts the other of the stop elements to hold the latch means in a closed position with a substantial portion of the circular periphery of the lock member underlying the deck around the opening. Continued rotation of all of the shafts will draw the lock members up under the deck to compress the seal carried by the cover plate and to sealingly lock the cover plate over the opening.

BRIEF DESCRIPTION OF THE DRAWINGS

The actual construction, operation, and the apparent advantages of the present invention will be better understood by referring to the drawings in which like numerals identify like parts and in which.

DESCRIPTION OF THE PREFERRED EMBODIMENTS

Figure 1:
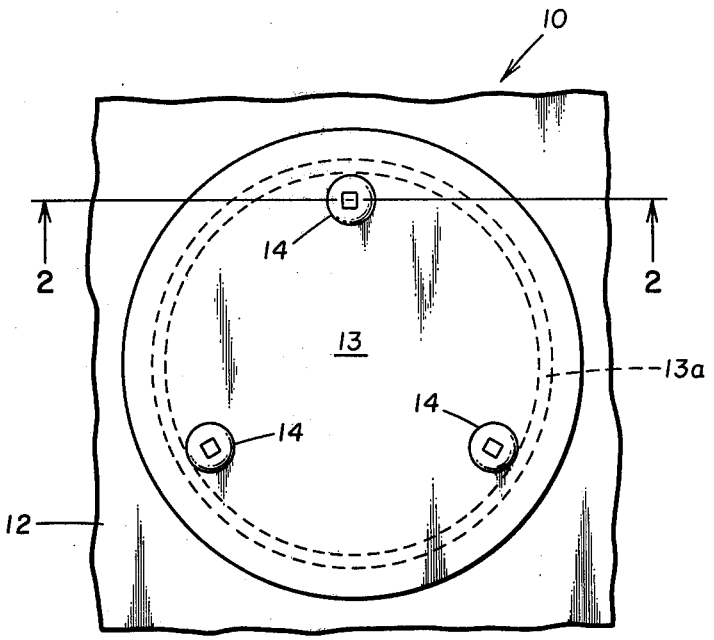
FIG. 1 is a plan view of the cover plate in accordance with the present invention.
Figure 2:
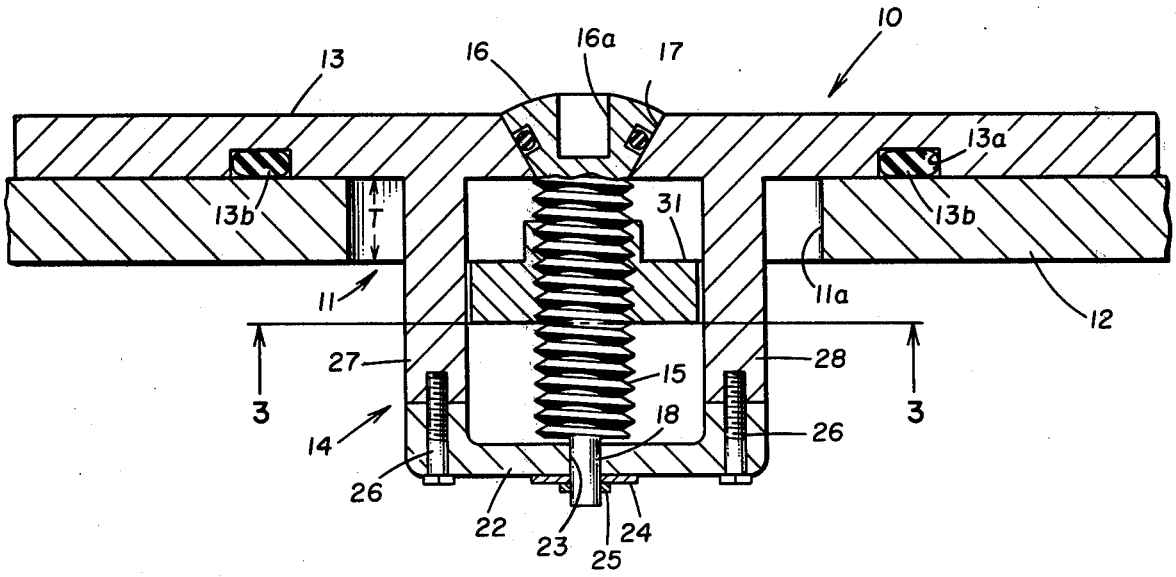
FIG. 2 is an enlarged view, partly in section, taken along section 2—2 of FIG. 1.

Referring more particularly to the drawings, FIGS. 1 and 2 disclose cover plate 10 in position over an opening 11 (FIG. 2) in deck 12 or the like. As disclosed, opening 11 is a service opening through a deck and into a cargo tank of an oil tanker and is the type of opening normally closed by a cover plate which is commonly known in the industry as a "Butterworth cover". Cover plate 10 is comprised of a plate element 13 having a circumferential groove **13*a* on the underside thereof in which a seal means, e.g., O-ring 13*b*, is positioned. Seal means 13*b* cooperates with deck 12 when cover plate 10 is in position over opening 11 to prevent leakage around plate element 13. Plate element 13 has a plurality of latch means 14 (three shown) preferably spaced equidistantly from each other near the outer periphery of plate element 13**.

As shown in FIG. 2, each latch means 14 is comprised of a shaft 15 having a head 16 journaled in passage 17 through plate element 13. Shaft 15 extends downward from the underside of plate element 13 and is threaded over most of its length. The length of shaft 15 below plate element 13 is greater than the thickness T (FIG. 2) of any deck 12 with which cover plate 10 will be used.

Figure 3:
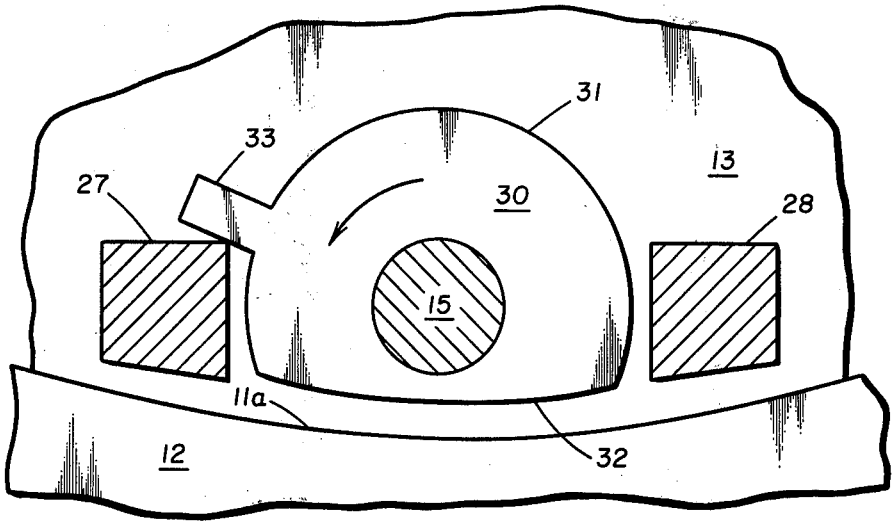
FIG. 3 is a slightly enlarged view taken along section 3—3 of FIG. 2 and showing the latching means in an open position.
Figure 4:
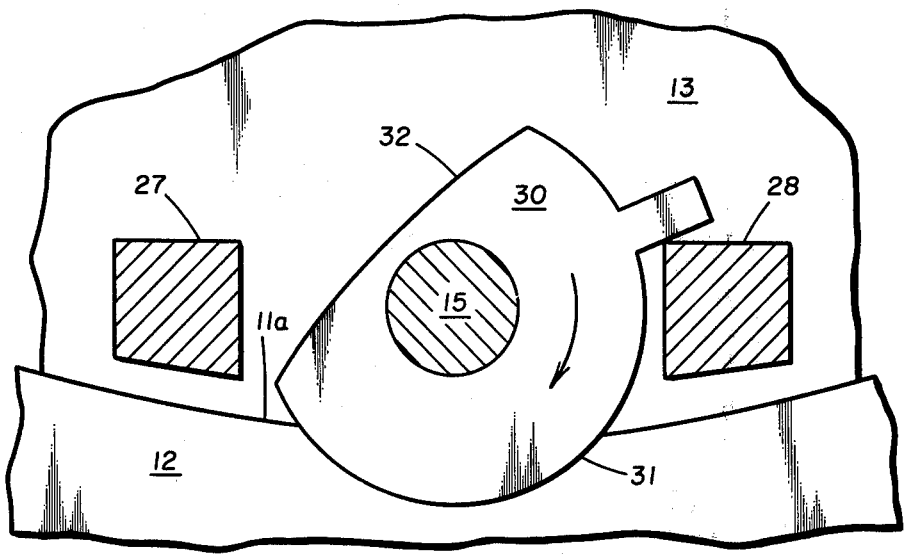
FIG. 4 is a slightly enlarged view taken along section 3—3 of FIG. 2 and showing the latching means in a closed position.

Seal means, e.g., O-ring 20, is positioned in groove 21 on head 16 of shaft 15 and cooperates with passage 17 through plate element 13 to prevent leakage around shaft 15. The lower end 18 of shaft 15 is journaled in support 22 through passage 23 and is held in position by means of washer 24 and a cotter pin 25 or the like which passes through end 18. Support 22 is secured by means of screws 26 or the like to stop elements 27, 28, which, in turn, are secured to the underside of plate element 13 and extend downward on opposite sides of shaft 15 as shown in FIGS. 2, 3, and 4. Stop elements 27, 28 are preferably cast as an integral part of plate element 13 but can be secured thereto by other means, e.g., welding.

A lock member 30 is threaded onto the threaded portion of shaft 15. As best seen in FIGS. 3 and 4, the periphery of lock member 30 is formed basically of a circular portion 31 and a flattened side 32. Attached to and extending outward from circular portion 31 is lug 33. The function of lock member 30 will be described in detail in the description of operation set out below.

As shown in FIG. 2, head 16 of shaft 15 is substantially level or flush with plate element 13 and has a socket **16*a* formed therein to receive a rachet or other operating tool for rotating shaft 15 in either a clockwise or a counterclockwise direction, as will be explained below. Head 16 is preferably made level with plate element 13 in response to the normal marine requirements for a minimum of obstructions on a ship's deck. However, it should be recognized that other operating tools, e.g., a permanent or a removable handle, could be provided for shaft 15** without departing from the present invention.

The operation of cover plate 10 is as follows. An operating tool (not shown) is inserted into socket **16*a* on head 16, and shaft 15 is rotated counterclockwise (as viewed in FIG. 3). Lug 33 will contact stop element 27 and will prevent lock member 30 from further rotation. In this position, flattened side 32 will be substantially parallel to the edge 11*a* of opening 11 so latch means 14 will be held in an open position relative to opening 11. With lug 33 against stop 27, continued rotation of shaft 15 will cause lock member 30 to move downward on shaft 15 for a distance greater than the thickness T of deck 12. After lock members 30 of all of latch means 14 on cover plate 10 are in this position, cover plate 10 is positioned over opening 11 in deck 12 and shaft 15 is rotated clockwise as viewed in FIG. 4. This rotation also rotates lock member 30 until lug 33 contacts stop element 28. Now, a substantial portion of the circular portion 31 of lock member 30 will underlie deck 12 and latch means 14 will be in a closed position. Continued rotation of shaft 15 will cause lock member 30 to move upward into contact with the underside of deck 12. Slight additional rotation of shaft 15 will draw plate element 13 snuggly onto the deck to compress seal means 13*b*. This is repeated with all of the latch means 14 to sealingly lock cover plate 10 over opening 11. The operation is merely reversed to remove cover plate 10**.

It can be seen that no special tools or additional parts are required to adapt the present cover plate for use with different deck thicknesses. By merely rotating shaft 15, lock member 30 can be moved to a variety of positions on shaft 15 to correspond to the wide range of deck thicknesses likely to be encountered on cargo vessels commonly in use. Rotating shaft 15 in an opposite direction will then quickly lock the cover plate in place.

What is claimed is:

1. A cover plate for closing an opening through a deck or the like, said cover plate comprising:

a plate element slightly larger than said opening to be closed;

a seal means on the underside of said plate element for cooperating with said deck or the like around said opening to prevent leakage around said cover plate when said cover plate is in an operable position; and a plurality of adjustable latch means spaced around and near the outer periphery of said plate element, each of said latch means comprising:

a shaft extending through and journaled to said plate element and having a threaded portion extending from the underside of said plate element;

a lock member threaded onto said threaded portion of said shaft, the periphery of said lock means having a substantially circular portion and a flattened side;

a lug attached to said lock member;

stop means extending from the underside of said plate element adjacent said threaded portion of said shaft whereby said lug will contact said stop means when rotated in one direction to hold said lock member in an open position and to allow said lock member to move downward on said shaft and whereby said lug will contact said stop means when rotated in an opposite direction to hold said lock means in an closed position and to allow said lock member to move upward on said shaft.

2. The cover plate of claim 1 including:

seal means between said shaft and said plate element to prevent leakage around said shaft.

3. The cover plate of claim 2 wherein said seal means between said shaft and said plate element comprises:

a groove in said shaft element adjacent said plate element; and an O-ring seal carried by said groove.

4. The cover plate of claim 3 wherein said seal means on the underside of said plate element comprises:

a circumferential groove extending around the underside of said plate element; and an O-ring seal carried by said groove.

5. The cover plate of claim 2 including:

a head on said shaft substantially level with the upper side of said plate element; and means on said head for rotating said shaft.

6. The cover plate of claim 3 wherein said means for rotating said shaft comprises:

a socket formed in said head adapted to receive an operating tool.

7. The cover plate of claim 2 wherein said stop means comprises:

a pair of stop elements affixed to and extending from the underside of said plate element, said stop elements extending substantially parallel to and on opposite sides of said shaft.

8. The cover plate of claim 7 including:

a support affixed to and extending between said two stop elements, and wherein the lower end of said shaft is journaled in said support.

9. The cover plate of claim 8 including:

a head on said shaft substantially level with the upper side of said plate element; and means on said head for rotating said shaft.

10. The cover plate of claim 9 wherein said means for rotating said shaft comprises:

a socket formed in said head adapted to receive an operating tool.

* * * * *